United States Patent [19]

Anderson

[11] Patent Number: 4,832,121

[45] Date of Patent: May 23, 1989

[54] METHODS FOR MONITORING TEMPERATURE-VS-DEPTH CHARACTERISTICS IN A BOREHOLE DURING AND AFTER HYDRAULIC FRACTURE TREATMENTS

[75] Inventor: Roger N. Anderson, New York, N.Y.

[73] Assignee: The Trustees of Columbia University in the City of New York, New York, N.Y.

[21] Appl. No.: 103,940

[22] Filed: Oct. 1, 1987

[51] Int. Cl.[4] ..... E21B 43/26; E21B 47/06

[52] U.S. Cl. ..... 166/254; 166/66; 166/250; 166/308; 73/154; 73/155

[58] Field of Search ..... 166/250, 254, 308, 64, 166/66; 73/154, 155

[56] References Cited

U.S. PATENT DOCUMENTS

| | | | |
|---|---|---|---|
| Re. 27,459 | 8/1972 | Guinn et al. | 73/154 X |
| 3,363,457 | 1/1968 | Ruehle et al. | 73/154 |
| 3,454,094 | 7/1969 | Grolemund et al. | 166/64 X |
| 3,480,079 | 11/1969 | Guinn et al. | 166/250 |
| 3,709,032 | 1/1973 | Coles, Jr. et al. | 73/154 |
| 3,745,822 | 7/1973 | Pierce et al. | 73/154 |
| 3,795,142 | 3/1974 | Smith et al. | 73/154 |
| 3,913,398 | 10/1975 | Curtis | 73/154 |
| 3,954,140 | 5/1976 | Hendrick | 166/50 |
| 4,109,717 | 8/1978 | Cooke, Jr. | 166/250 |
| 4,120,199 | 10/1978 | Mufti | 73/154 |
| 4,185,691 | 1/1980 | Tubin et al. | 166/64 X |
| 4,279,299 | 7/1981 | Shuck | 166/250 X |
| 4,344,484 | 8/1982 | Ridley | 166/64 X |
| 4,393,933 | 7/1983 | Nolte et al. | 166/250 |
| 4,520,666 | 6/1985 | Coblentz et al. | 73/155 |
| 4,559,818 | 12/1985 | Tsang et al. | 73/154 |
| 4,676,664 | 6/1987 | Anderson et al. | 73/154 X |

FOREIGN PATENT DOCUMENTS

| | | | |
|---|---|---|---|
| 1211411 | 2/1986 | U.S.S.R. | 73/155 |

OTHER PUBLICATIONS

"The Oceanography Report", Taylor et al., Eos, vol. 67, No. 13, p. 154, Apr. 1, 1986.

"Automatic Data Acquisition System Installed in Offshore Canadian Arctic Well: Monitoring Precise Temperatures by Acoustic Telemetry", Judge et al., Proceedings, Oceans Conf., Marine Tech. Society and IEEE Ocean Engineering Society, Halifax, N. S., vol. 1, pp. 156–160, (1987).

*Primary Examiner*—George A. Suchfield

*Attorney, Agent, or Firm*—Brumbaugh, Graves, Donohue & Raymond

[57] ABSTRACT

A method for monitoring in real time the growth of a hydraulic fracture in an earth formation traversed by a well borehole. Growth of the fracture is observed by measuring the temperature of the borehole fluid at selected times during the fracturing process. The temperature measurements are made by use of a string of vertically-spaced temperature sensors extending over the entire fracture depth interval, and a temperature-vs-depth profile of the fracture interval is generated in real time at the surface. Post-fracture temperature monitoring of the fracture zone affords information useful in estimating fracture volume and in well-flow planning and production scheduling.

15 Claims, 2 Drawing Sheets

METHODS FOR MONITORING TEMPERATURE-VS-DEPTH CHARACTERISTICS IN A BOREHOLE DURING AND AFTER HYDRAULIC FRACTURE TREATMENTS

FIELD OF THE INVENTION

The present invention relates generally to temperature-vs-depth logging in well boreholes and, more particularly, to improved methods for in situ monitoring of the change over time in the temperature-vs-depth characteristics of earth formations. One particularly useful application of the invention involves monitoring the hydraulic fracture treatment of a hydrocarbon well by detecting in real time changes in temperature of the borehole fluid in the fracture zone during and after the fracturing process to ascertain the physical and hydrological properties of the fracture.

BACKGROUND OF THE INVENTION

Various techniques are conventionally employed in oil and gas well field operations to enhance hydrocarbon recovery. One such technique is hydraulic fracturing of a hydrocarbon-bearing formation to improve hydrocarbon flow from the formation to a producing oil or gas well. In an hydraulic fracturing process or treatment, a fluid, such as a sand-water slurry, is injected into the borehole through a tubing string to the depth interval of interest. The fluid is injected at a rate and pressure sufficient to cause the formation within the selected depth interval to fracture. A propant may then be introduced into the fractured zone to keep the fracture open, thereby enhancing the productivity of the well.

The hydraulic fracturing treatment of oil or gas wells is a time consuming and expensive process, and repeated treatments are sometimes required. Following treatment, substantial additional investments of time and money may well be made in attempting to recover hydrocarbons from the fractured zones. It is important, therefore, that reliable information be available to the well operator regarding the effectiveness of the fracturing treatment. Ideally, this information should be available in situ in real time, i.e., as the fracture event is actually happening in the field.

Prior art techniques for evaluating fracture treatments have included the use of seismic hydrophone arrays, ultrasonic televiewers in the fracture interval, flow meters in the fracture interval, and gamma ray logs after seeding the propant with radioactive tracers. Temperature logs or surveys produced after completion of the treatment, such as those described in U.S. Pat. Nos. 3,480,079, 3,795,142 and 4,109,717, have also been employed. None of these techniques, however, meet the aforementioned need for in situ real time knowledge of fracture growth and extent.

It is an object of the invention, therefore, to provide a method for effectively and reliably monitoring the in situ growth of an hydraulic fracture during the fracturing process.

A further object is to perform the aforementioned monitoring in a way to provide real-time well site information of the fracture growth.

Additionally, an object is to provide a method for the improved evaluation of the production capacity of a fractured zone by providing information of the physical and hydrological properties of the fracture.

Still another object is to monitor the temperature changes in a well over an extended period of time, which could be the lifetime of the well, to facilitate evaluation of the production history of the well.

Still a further object of the invention is to monitor the temperature-vs-depth characteristics of a borehole over time in general, apart from the hydraulic fracture treatment of well bores.

SUMMARY OF THE INVENTION

These and other objects of the invention are attained, in accordance with one aspect of the invention, by making in situ temperature measurements during and/or after an hydraulic fracturing process at a plurality of vertically-spaced points over the fracture interval to measure growth of the fracture in real time. This is done by placing one or more springs of vertically-spaced temperature sensors over the depth interval selected to be fractured. In accordance with the invention, the temperature string or array may be permanently placed in the borehole to provide a temperature-monitoring capability over an extended time period. The sensor string or array may be suspended within the borehole or may be implanted in the borehole structure, e.g., in cased wells, or on the casing or the cement sheath. Measurements from the individual sensors are transmitted to the surface and used to generate a real time temperature-vs-depth profile of the fracture interval. By observing the change in the temperature-vs-depth profile as the fracturing treatment proceeds, the growth and physical extent of the fracture may be monitored and controlled at the well site in real time. By monitoring the temperature response of the well bore after fracturing, production capacity can be predicted quickly and accurately. Actual production can be monitored for months and even years after the treatment.

The invention thus provides both for real time and for long term continuous temperature monitoring in a borehole. Wells employing these in situ temperature monitoring capabilities may be referred to as "intelligent" or "smart" wells.

In a preferred embodiment, the temperature measurements are made using one or more strings of temperature sensors suspended in the borehole from a conventional logging cable. Any suitable sensors may be employed, but a thermistor array capable of producing a multichannel digital readout is preferred. The thermistor (or other sensor) string or strings should extend over the entire height of the depth interval to be fractured and preferably for some distance both above and below the fracture interval. The spacing between vertically adjacent sensors in a string may be selected to afford the desired profile definition. For typical borehole and formation conditions, a suitable spacing would be on the order of the approximate radius of the borehole.

Temperature measurements from the sensor strings may be made continuously or at least at selected times during and following the fracture treatment process. These readings are transmitted over an electrically conducting cable to the surface for recording and for generation of a real time display of a temperature v. depth profile of the fracture interval. No movement of the temperature sensors in the borehole is required to generate such a profile. Such profiles are preferably repeatedly generated at selected times as the fracturing process continues. Generally, the time intervals between profiles are short early in the process, e.g., every few seconds, and are gradually lengthened as time goes on.

From these displays and the recorded data, the physical parameters and the hydrological properties of the fracture may be observed and determined, thereby providing a more reliable estimate of the produceability of the well. The real productivity can then be monitored throughout the life of the well.

DETAILED DESCRIPTION OF THE PREFERRED EMBODIMENTS

Figure 1:
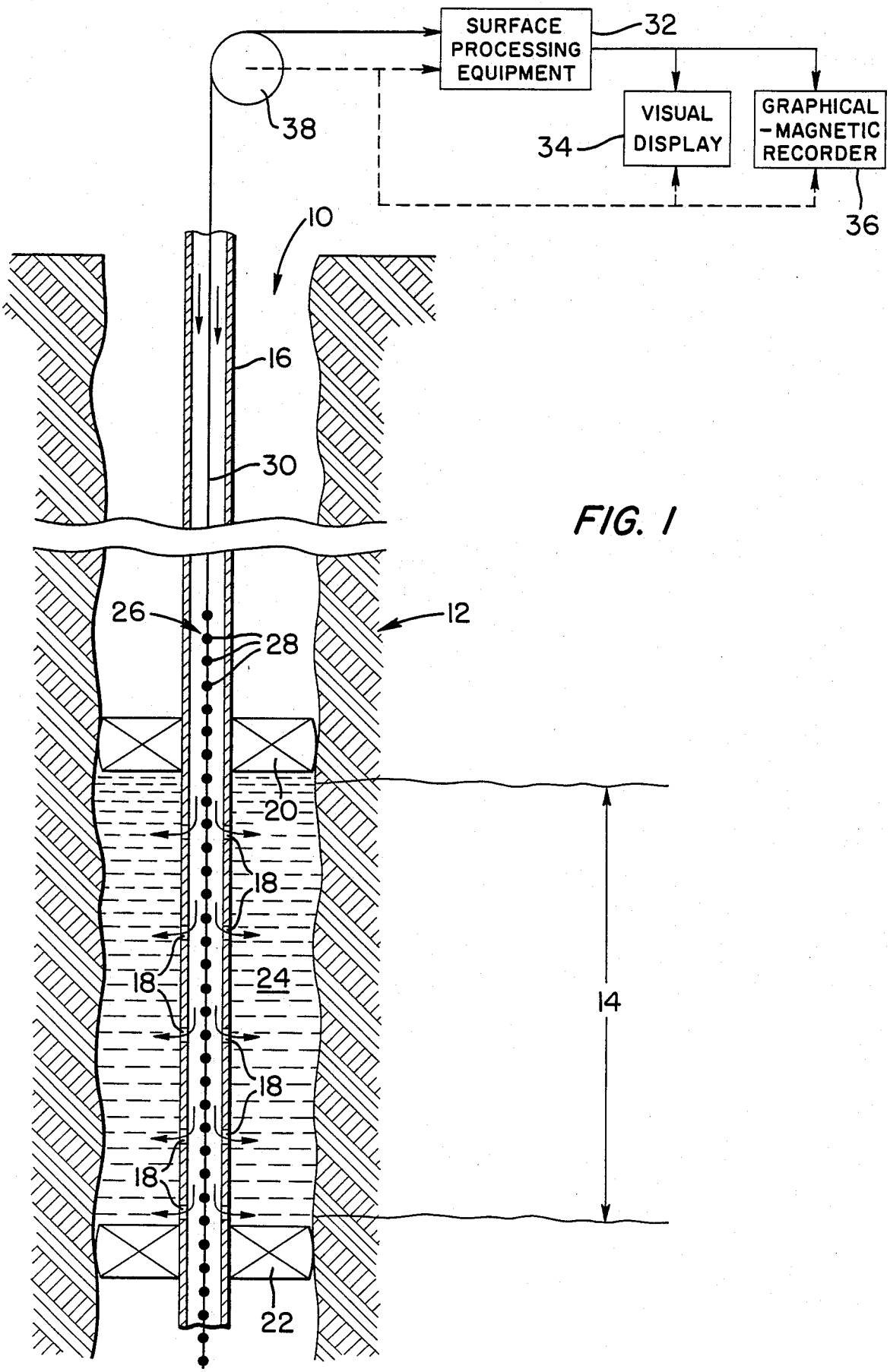
FIG. 1 is a schematic view of a well borehole and illustrating embodiment of the present invention.

With reference to the drawings, a representative embodiment of the invention is described below in connection with a well borehole 10 which traverses an earth formation 12 including a productive zone 14. A tubing string 16 is suspended within the borehole and is formed with perforations 18 opposite the productive zone 14.

If the zone 14 is selected for hydraulic fracture treatment to enhance produceability, the depth interval to be fractured is sealed at its upper and lower ends by packers 20 and 22, respectively, interposed between the tubing 16 and the formation 12. This constrains the frac fluid to the packed region 24 of the borehole opposite zone 14. Although the tubing string 16 is show as extending below the zone 14, it will be understood to be plugged or otherwise sealed below the packer 22, so that the only fluid path from the tubing string is through the perforations 18.

The borehole 10 is shown in FIG. 1 as open, i.e., uncased. This is by way of illustration only, however, and the invention is applicable to cased holes as well. Similarly, the tubing string 16 need not be present or, alternatively, could terminate at the level of the upper packer 20, as, for example, where the fracture interval is adjacent the borehole bottom.

In accordance with the invention, a string 26 of vertically-spaced temperature sensors 28 is suspended within the tubing 16 at the end of a conventional logging cable 30. The temperature sensors 28 may comprise any suitable devices, such as thermistors or the like, capable of detecting temperature changes to the desired degree of accuracy over the desired range and of withstanding the harsh borehole conditions encountered in practice. For off-shore applications, for example, the sensors are preferably capable of measuring to an accuracy of 0.01° C. relative, and 0.1° C. absolute, over the range of from 0° C. to 150° C. For on-shore applications, again by way of example, the sensors are preferably capable of measuring to the aforementioned accuracy over the range of from 20° C. to 150° C. These are considered to be the optimal performance criteria for the conditions described, and are not to be understood as limitations on either the accuracy or the range of temperature measurements useful in accordance with the invention.

In a preferred embodiment of the invention, the sensor string 26 is comprised of solid-state thermistor chips as described in the commonly-assigned U.S. Pat. No. 4,676,664, issued June 30, 1987 to Roger N. Anderson et al. (See FIG. 18 and the related parts of the specification.) The sensor string 26 also preferably incorporates the temperature measuring circuitry and the multiplexing circuitry of the Anderson et al. patent for making the measurements and for transmitting the results from the multiplicity of thermistors 28 to the surface within the signal-carrying capacity of the logging cable 30. (See FIGS. 19 and 20 and the related parts of the specification.) The relevant portions of the Anderson et al. '664 patent are hereby incorporated by reference.

As illustrated in FIG. 1, the sensor string 26 extends over the entire depth interval to be fractured, in this case that of zone 14, and to some extent both above and below the interval. Advantageously, though not essentially, the sensor string 26 may be twice as long as the packed interval, i.e., the distance between the packers 20 and 22, and placed so that it is approximately centered in the packed interval. The spacing between vertically adjacent sensors 28 should be selected to provide the desired temperature-vs-depth resolution. Under typical field conditions (borehole and formation), a spacing of one sensor every borehole radius is preferred, thereby providing two temperature measurement per each borehole diameter of depth. With this spacing, a typical application of the invention might include 100 to several hundred sensors within the packed interval.

Although the sensor string 26 is shown in FIG. 1 as suspended within the tubing 1,, it could be placed within the borehole 10 in other ways as well. For example, it could be attached to or incorporated in the tubing 16 itself. Or, if the well is cased, it could be attached to or incorporated in the casing or embedded in the cement sheath surrounding the casing. Also, although only one string 26 is illustrated in FIG. 1, plural strings could be provided. In fact, this would be preferred where damage to one or more strings might be anticipated, as, for example, where perforation of the casing and surrounding cement sheath might damage a string or strings embedded in the casing or cement sheath. In such case, plural strings 26 circumferentially spaced around the borehole, e.g., at 90° intervals, could be used to minimize the likelihood of damage to all strings.

In any event, the string or strings 26 and associated measurement and telemetering circuitry are preferably, though not necessarily, placed in the borehole 10 on a permanent or semi-permanent basis to provide for the continued monitoring of borehole temperatures over time. By this is meant that the sensor string(s) remains in the borehole throughout the time period over which temperature monitoring is to be carried out, and is not removed from the region of interest after each measurement cycle as is a movable logging tool. Hence, the present invention is not restricted in application or frequency of utilization by the need to introduce a logging tool into the borehole and move it along the depth interval of interest. Such in situ "smart" well site capabilities facilitate the making of temperature-vs-depth measurements at any desired time over the production life of the well.

The temperature measurements from the sensors 28 are multiplexed on the cable 30 and transmitted to surface processing equipment 32 (as described in the aforementioned Anderson et al. U.S. Pat. No. 4,676,664), where they are decoded, shaped, amplified or otherwise processed as desired for use in generating a real time visual display, as at 34, of the temperature-vs-depth information over the packed interval. The temperature-vs-depth data are also applied to a conventional graphical and/or magnetic recorder 36 for production of a strip log and/or magnetic log of the packed interval. For that purpose, a signal representative of a reference depth of the sensor string 26 within the borehole 10 is transmitted from a conventional cable-movement measuring device 38 to the surface processing equipment 32, the display 34, and the recorder 36. The depth locations of the individual sensors 28 relative to this reference depth may be readily calculated. As will also be understood, the temperature and depth data may be recorded at the well site for subsequent processing at a remote location whether or not a well-site display is generated.

As previously mentioned, one advantage of the present invention is that a temperature-vs-depth output or display of the fracture interval may be generated at the well site in real time, i.e., while the fracture event is actually occurring i the field. This allows the growth of the fracture to be monitored both during and after the fracture treatment. From the data thus obtained, the growth of the fracture may be controlled during the fracture process. Also, information of the physical and hydrological properties of the fracture may be ascertained for use in evaluating the produceability of the fractured zone.

To those ends, the surface processing equipment 32 includes a suitably programmed digital computer for manipulating the temperature and depth data from the sensors 28 so as to generate the desired display. Before fracture treatment begins, a "baseline" thermal gradient is recorded in the computer memory, and all subsequent temperature measurements made by each sensor at each depth are differenced with the "baseline" values recorded in memory.

Figure 2:
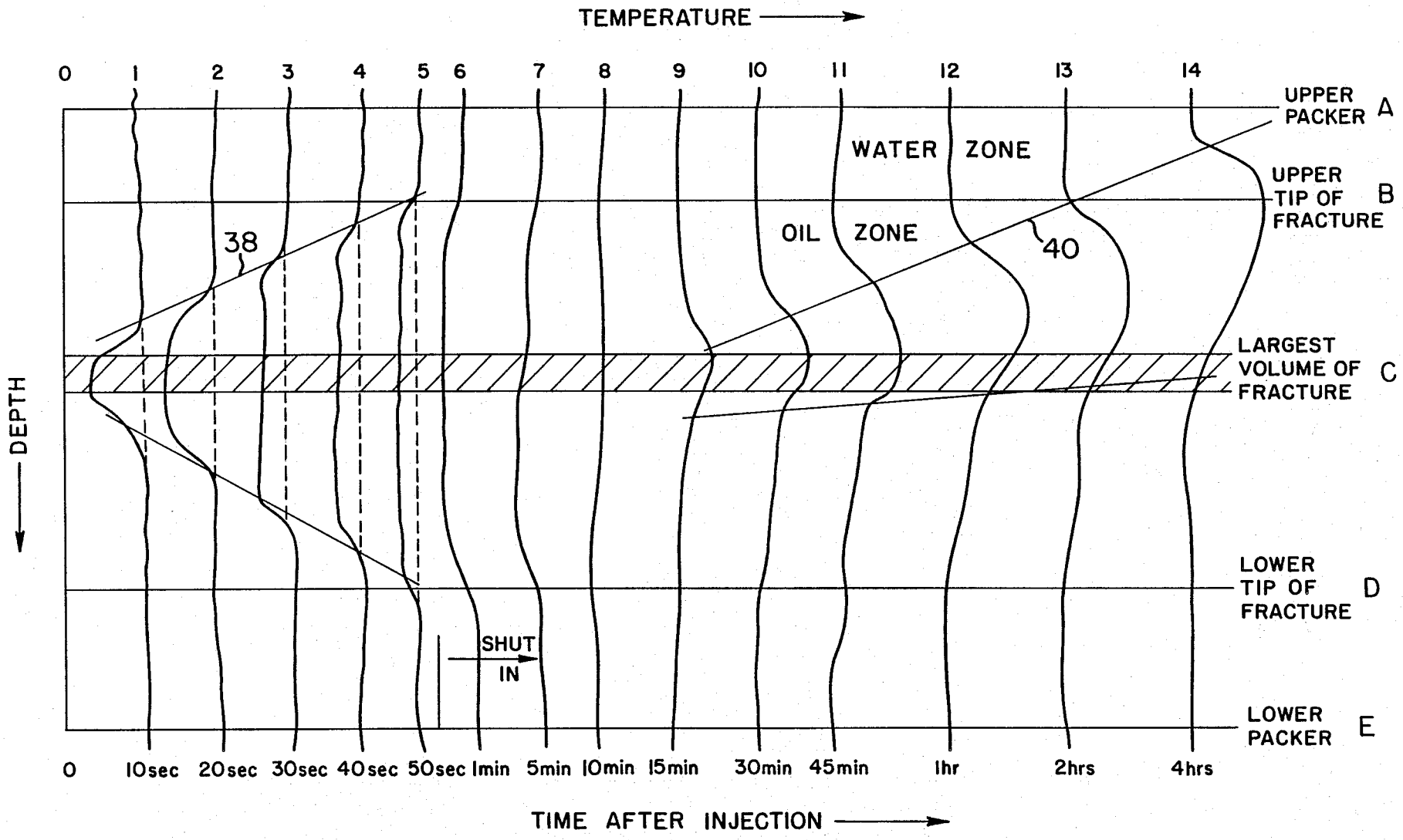
FIG. 2 is an illustrative display of temperature vs. depth profiles, as normalized to eliminate the geothermal gradient, at different times during and following the fracturing treatment process.

FIG. 2 shows an illustrative open hole temperature-vs-depth output such as might be generated in real time, in accordance with the invention, on a storage-type oscilloscope or other CRT display located at the well site. The numbers 0–14 along the top of the figure represent temperature-vs-depth profiles at different times during and after the hydraulic fracturing process. Temperature increases towards the right of the view and depth increases towards the bottom of the view. As temperature normally increases with depth beneath the earth's surface, the typical geothermal gradient would slope downwards to the right in FIG. 2. For simplicity, however, the temperature profiles of FIG. 2 have been normalized to remove this gradient.

At the beginning of an hydraulic fracture treatment, the frac fluid, e.g., a sand-water slurry and possibly including a surfactant, propant, or other constituents, is injected at surface temperature (typically much colder than the formation temperature) and at high pressure through the tubing 16 and into the packed region 24 opposite zone 14. Alternatively, the frac fluid could be heated or cooled to at least about 10° C. hotter or colder than the formation temperature. Since prior to initiation of a fracture, the frac fluid is confined to the tubing 16 and the region 24, the borehole fluid temperature sensed by the sensors 28 is substantially uniform over the entire thermistor string 26. This is represented in FIG. 2 by profile 0.

Repeated temperature-vs-depth profiles are generated at successively later times as pumping is continued and fracture occurs. Profiles 1–5 in FIG. 2 depict this stage of the treatment. At profile 1, fracture has occurred and the colder surface fluid is being forced into the formation 12, resulting in a deflection of the profile in the packed region in the direction of decreasing temperature, i.e., to the left in FIG. 2. Horizontal lines A and E in FIG. 2 represent the upper and lower limits, respectively, of the packed interval. Initially, the displacement in profile occurs at the region of greatest fracture volume, indicated in FIG. 2 by cross hatching opposite level C. Profiles 2–5 show the progressive displacement in profile shape with time following fracture as pumping is continued and the fracture grows and increases in height and volume. The time period between successive profile 0–5 should be short enough to allow the change in profile shape to be determined with adequate resolution i.e., so that fracture growth can be observed and controlled before it grows beyond the oil zone and enters the water zone. For example, a time offset on the order of a few seconds between profiles may be used during this stage of the treatment. Ten second intervals between successive profiles are shown along the time axis in FIG. 2 by way of example. When the fracture has grown to the desired height, pumping is stopped and the well is shut in. As shown in FIG. 2, the decision to shut in is made when the fracture reaches or approaches the oil-water interface which is indicated in FIG. 2 at line B. The depth of the oil-water interface or other critical depth level is normally known from prior well logs or other sources. This decision may be made manually by observing fracture growth from a CRT display of the profiles 1–5, or the surface processing equipment 32 may be programmed automatically to stop pumping when the temperature change at the critical depth, e.g. the depth of the oil-water interface, indicates that fracture growth is approaching or has reached that depth level. For instance, the equipment 32 may be programmed to stop pumping when the temperature difference at line B between profile 0 and a subsequent profile, e.g. 5, reaches a predetermined value, e.g. 1° C.

FIG. 2 illustrates how real-time temperature monitoring, i.e., while the fracturing process is still ongoing, affords useful information of and control over the growth of the fracture. As shown by profiles 1–5, the fluid temperature in the packed interval gradually increases as the fluid is heated through contact with the hot formation rock. As the fracture grows, the depth interval over which the fracture extends, i.e., the fracture height, appears in the successive profiles 1, 2, 3, 4, 5 as a broadening of the fracture growth envelope 38. By monitoring and observing this growth, it is possible in accordance with the invention not only to determine fracture height, which may be seen directly from the profiles in the case of an open hole, but it is also possible to control fracture height so as to optimize the hydraulic fracture treatment process. Such control of the fracture treatment process was not possible with prior art techniques, such as that of U.S. Pat. No. 3,795,142, for instance, where temperature monitoring did not begin until after well shut-in.

Profiles 6–9 in FIG. 2 represent borehole temperature conditions after the well has been shut in and the temperatures in the packed interval begin returning to equilibrium as the formation-heated fluid begins to flow back into the borehole. During this stage, the sharp anomaly in the temperature-vs-depth profile delineating the fracture interval gradually disappears. By observing the rate at which this occurs still further information regarding the physical and hydrological properties of the fracture may be ascertained. The time offsets between profiles 6–9 may be the same as between earlier profiles or different offsets may be selected. As shown in FIG. 2, for example, four-to-five minute offsets are employed between profiles 6–9. The frequency at which profiles are generated in this stage is generally not as important as during the fracture process itself, since fracture growth has stopped.

As shown by profiles 6–9, the temperature in the packed region has changed over from colder to hotter than the initial injection baseline profile 0 as the fluid is heated by contact with the hot formation rock. This temperature shift becomes more pronounced as the well is produced and back flow to the surface occurs. This is depicted by profiles 10–14, which illustrate the temperature-vs-depth characteristics of the borehole at still later times following injection, e.g. from one-half to four hours thereafter. These are illustrative times only, and in fact the signature of the temperature-vs-depth profile over the fracture interval may remain detectable for a relatively long period of time. The permanent nature of the sensor string(s) 26 of the present invention facilitates the monitoring and generation of such temperature characteristics at any desired time over the lifetime of the well, even months or years after fracture treatment.

Furthermore, by application of plume theory the invention affords information of the volume of the fracture reservoir. The manner in which the thermal plume of producing fluid entering the well is detected in accordance with the invention is shown by profiles 9–14 of FIG. 2. As backflow to the surface begins, the temperature-vs-depth profile is displaced to the right in FIG. 2 (profile 9) in the region of maximum fracture volume (level B). Thereafter, as production continues, the rightward displacement becomes more pronounced and also moves upward along the borehole (profiles 10–14). By monitoring the progressive development of the plume, indicated in FIG. 2 by the plume envelope 40, the fracture volume can be ascertained from known plume theory, as disclosed, for example, in U.S. Pat. No. 4,520,666 issued June 4, 1985 to Coblentz et al. The pertinent portions of the Coblentz et al. '666 patent are hereby incorporated by reference. The thermal plume from the hot production fluid will persist so long as production is continued, and may be repeatedly monitored over time in accordance with the invention for purposes of production scheduling or the like.

As an alternative to backflowing fluid to the surface and observing the change over time in the temperature-vs-depth profiles as in FIG. 2, the fracture volume could be determined by leaving the well shut in and by monitoring the return of the temperature profile to equilibrium. The manner in which an estimate of reservoir volume may be derived from such temperature measurements is described by Carslaw and Jaegler in "Conduction of Heat in Solids", Oxford University Press, 1959.

As mentioned, FIG. 2 depicts temperature-vs-depth profiles for the case of an open hole, where fluid flow to and from the fracture communicates directly with the borehole over the full height of the packed interval. In cased holes, however, flow communication between the borehole and the fracture is confined to the perforated region, which often is of lesser height than the fracture. Except in the perforated region, therefore, heat transfer between the borehole and the fracture often depends on conduction and/or convection through the casing and cement sheath. This results in a slower response of the temperature-vs-depth profile (in the non-perforated regions) than occurs in open holes, and reduces the definition with which full fracture height can be ascertained from the profiles in real time. Hence it is desirable to be conservative in shutting in a cased well based on observation of the temperature-vs-depth profile over the packed zone. Alternatively, the fracture treatment could be conducted in stages, with each stage comprising a pressure pulse, rapid shut-in, and a waiting period to allow full development of the temperature-vs-depth profile through conduction/convection between the borehole and fracture. In this way, the full height of the fracture could be determined from the profile of each stage before deciding whether a further pressure pulse is needed.

As with open boreholes, the fracture reservoir volume can be estimated in cased holes by application of plume theory to the results of temperature monitoring in the fracture zone after backflow to the surface is begun. Here again, however, a conservative estimate is obtained because of the effects of fluid flow to the borehole being confined to the perforated region of the casing. Fracture volume can also be ascertained by long term monitoring of the return to temperature equilibrium of the borehole after shut in, which is dependent upon heat transfer to the borehole through conduction and/or convection in the casing and cement sheath.

Although the invention has been described with reference to specific embodiments thereof, many modifications and variations of such embodiments may be made without departing from the inventive concepts disclosed. For example, instead of employing a frac fluid that is cooler than the formation rock, a hotter fluid may be used and the temperature-vs-depth changes measured and displayed as the frac fluid cools in the fracture zone. The foregoing and all other such modifications and variations are intended to be included within the spirit and scope of the appended claims.

I claim:

1. A method for monitoring the hydraulic fracture of an earth formation traversed by a well borehole, comprising:

placing a string of vertically-spaced temperature sensors in the well borehole over a depth interval to be subjected to hydraulic fracturing treatment;

producing a fracture in the earth formation surrounding said depth interval by applying hydraulic pressure thereto, whereby the borehole fluid is caused to flow into the formation fracture; and measuring the temperature of the borehole fluid at said vertically-spaced temperature sensors at least at selected times during the fracture-producing step to provide information of the growth of the fracture in real time.

2. The method of claim 1 further comprising generating an output of the temperatures measured at said vertically-spaced sensors as a function of the respective depths of said sensors in the well borehole.

3. The method of claim 2 wherein said temperature-vs-depth output is generated at the well site in real time.

4. The method of claim 3 further comprising employing said temperature-vs-depth output to control the growth of the fracture during the fracture-producing step.

5. The method of claim 3 further comprising employing said temperature-vs-depth output in determining when to shut in the well.

6. The method of claim 3 wherein said output comprises a visual display, whereby the growth of the fracture may be viewed in real time at the well site.

7. The method of claim 6 wherein said visual display is generated on a CRT display.

8. The method of claim 1 further comprising recording the temperatures measured at said vertically-spaced sensors as a function of the respective depths of the sensors in the well borehole.

9. The method of claim 1 wherein said string of vertically-spaced temperature sensors extends both above and below the vertical extent of the depth interval to be subjected to the fracturing process.

10. The method of claim 1 wherein the vertical spacing between adjacent ones of said temperature sensors is approximately one-half the borehole diameter.

11. The method of claim 1 further comprising employing said temperature measurements to determine estimates of physical parameters of the fracture.

12. The method of claim 11 wherein said physical parameters include the height of the fracture.

13. The method of claim 12 further comprising employing said estimate of fracture height to control the fracture-producing process so as to control the growth of the fracture.

14. The method of claim 1 wherein said measuring step included making said temperature measurements at selected times after-shut in of the well.

15. The method of claim 14 further comprising employing at least said post shut in temperature measurements to determine an estimate of fracture volume.

* * * * *